United States Patent [19]

Schnedler et al.

[11] 4,152,471

[45] * May 1, 1979

[54] METHOD FOR CONTINUOUSLY CONTACT-COATING ONE SIDE ONLY OF A FERROUS BASE METAL STRIP WITH A MOLTEN COATING METAL

[75] Inventors: Paul E. Schnedler, Middletown; Marvin B. Pierson, Franklin; Hart F. Graff, Middletown; Thomas A. Compton, Middletown; William R. Leasure, Middletown, all of Ohio

[73] Assignee: Armco Steel Corporation, Middletown, Ohio

[ * ] Notice: The portion of the term of this patent subsequent to Apr. 4, 1995, has been disclaimed.

[21] Appl. No.: 834,522

[22] Filed: Sep. 19, 1977

Related U.S. Application Data

[63] Continuation-in-part of Ser. No. 668,241, Mar. 18, 1976, Pat. No. 4,082,868.

[51] Int. Cl.[2] ..... C23C 1/08; C23C 1/02; C23C 1/06

[52] U.S. Cl. ..... 427/310; 427/313; 427/319; 427/320; 427/321; 427/329; 427/349; 427/374 D; 427/374 E; 427/432; 427/433; 427/434 A; 204/145 F; 118/63; 118/65; 118/419; 134/41

[58] Field of Search ..... 427/329, 349, 374 D, 427/374 E, 432, 433, 434 A, 431, 310, 313, 319, 320, 321; 204/145 F; 118/63, 65, 419, 401, DIG. 2, 407, 410; 134/41

[56] References Cited

U.S. PATENT DOCUMENTS

| | | | |
|---|---|---|---|
| 1,252,363 | 1/1918 | Roberts | 427/433 |
| 1,496,309 | 6/1924 | Girvin | 118/407 |
| 2,082,622 | 6/1937 | Fink | 427/432 X |
| 2,374,926 | 5/1945 | Fink | 427/434 |
| 2,824,020 | 2/1958 | Cook et al. | 427/313 |
| 2,937,108 | 5/1960 | Toye | 118/DIG. 2 |
| 3,526,536 | 9/1970 | Spengos et al. | 427/434 X |
| 3,751,288 | 8/1973 | Alsey et al. | 427/349 X |
| 3,809,570 | 5/1973 | Herman | 427/432 X |
| 3,993,235 | 11/1976 | Boynton | 118/410 |
| 4,082,868 | 4/1978 | Schnedler et al. | 427/329 |

FOREIGN PATENT DOCUMENTS

| | | | |
|---|---|---|---|
| 848925 | 8/1970 | Canada | 148/6.35 |

OTHER PUBLICATIONS

Burnes & Bradley, Protective Coatings for Metals, Reinhold Pub. Corp., N.Y., 1955, pp. 29–31.

*Primary Examiner*—Ralph S. Kendall
*Attorney, Agent, or Firm*—Melville, Strasser, Foster & Hoffman

[57] ABSTRACT

Method and means for continuously contact-coating one side only of a ferrous base metal strip with a molten coating metal. One or more roll means are provided to conduct the strip surface to be coated above the surface of a bath of the molten coating metal. The strip surface to be coated is caused to travel sufficiently close to the molten coating metal bath surface that the surface tension and wetting characteristics of the coating metal will permit the formation of a meniscus which will continuously contact and coat the strip surface. The coating is subjected to jet finishing. The strip is maintained in a protective non-oxidizing atmosphere at least until the one side thereof is coated. Alternatively, at least that side of the strip to be coated with the molten coating metal is coated with a flux which remains on the strip until contacted by the coating metal meniscus. The strip may be maintained in the protective non-oxidizing atmosphere until it is sufficiently cooled to prevent the formation of a visible oxide on the uncoated side thereof. When the strip is exposed to an oxidizing atmosphere after coating and while still sufficiently hot to form a visible oxide coating on the uncoated side thereof, the strip will thereafter be subjected to acid cleaning, rinsing and drying operations.

17 Claims, 24 Drawing Figures

16a
22a 4a
4d
1
4
11b
20
11c
3
4e
11a
2
4c 5
9
10
6
18
7
8
1
4b
12
4
3
2a
17
13
20
4c
11
4a
15
16
22
14
3b
A
3a
19
51a
2
51

4
23

METHOD FOR CONTINUOUSLY CONTACT-COATING ONE SIDE ONLY OF A FERROUS BASE METAL STRIP WITH A MOLTEN COATING METAL

CROSS REFERENCE TO RELATED APPLICATION

This is a continuation-in-part application of the copending application in the name of the same inventors, filed Mar. 18, 1976, Ser. No. 668,241 and entitled METHOD AND MEANS FOR CONTINUOUSLY CONTACT COATING ONE SIDE ONLY OF A FERROUS BASE METAL STRIP WITH A MOLTEN COATING METAL now U.S. Pat. No. 4,082,868.

BACKGROUND OF THE INVENTION

1. Field of the Invention

The present invention relates to a method and means for continuously contact-coating one side only of a ferrous base metal strip with a molten coating metal, and more particularly to such a method and means whereby the strip need not be submerged in the bath of molten coating metal.

2. Description of the Prior Art

The method and apparatus of the present invention may be used to produce a ferrous base metal strip provided on one side only with a coating of any appropriate hot-dip coating metal such as, for example, zinc, zinc alloy, aluminum, aluminum alloy, terne, lead and the like. While not intended to be so limited, for purposes of an exemplary showing the method and apparatus of the present invention will be described in terms of their use in the product ion of a ferrous base metal strip coated one-side only with zinc or with aluminum.

In recent years there has been a growing demand for a ferrous base metal strip coated with a protective metal on one side only, as for example a steel strip which has been galvanized on one side. Such a product is particularly useful in industries such as the automotive, appliance and building panel industries. The galvanized side of sucy a product demonstrates excellent corrosion resistance while the uncoated side is characterized by excellent paintability and can readily be welded by spot welding techniques or the like. In instances where corrosion protection is required on only one side of the product, it will be understood that a one-side coated product will provide a considerable savings of the coating metal.

Prior art workers have devised a number of ways in which to produce a one-side coated ferrous base metal strip. In accordance with one procedure, the ferrous base metal strip is coated one-side with a "stop-off" (i.e. a barrier layer, non-wetting to the coating metal). The strip is conventionally hot-dip coated. Thereafter, the barrier layer is scrubbed off or otherwise removed.

U.S. Pat. No. 3,383,250 teaches a process wherein the metal strip is appropriately cleaned on both sides, brought to coating temperature and then is caused to be oxidized on one side only. The strip is thereafter caused to pass through a bath of molten coating metal which adheres to the unoxidized side only.

In accordance with another method, the strip is hot-dip coated on both sides with as much as possible of the coating on one side being removed by an air knife or jet. The remainder of the coating metal on the jetted side is then removed by an electrolytic deplating process.

Finally, electrolytic coating has been practiced to provide a one-side coated product. To this end, the strip to be coated passes about a roll partially submerged in an electrolyte. The exposed side of the strip has a metallic coating deposited thereon, while the other side of the strip remains uncoated, being protected by the roll about which it passes.

While these various prior art practices may produce acceptable products, they are characterized by certain deficiencies. In general, the prior art practices are expensive, requiring more steps than ordinary hot-dip coating and using extensive specialty equipment. Presently used masking techniques produce an uncoated surface of marginal quality for high-finish painting applications.

Prior art workers have used a hot metal meniscus to fully coat tubes and bars as taught in German Pat. No. 24 06 939. The process taught in this reference would not, however, be applicable to one-side coating of a ferrous base metal strip.

The method and apparatus of the present invention enable the rapid and continuous contact-coating of one side only of a ferrous base metal strip with a molten coating metal. Coating thicknesses can be controlled as in conventional two-side hot dip coating processes. No in-metal roll assemblies are required, eliminating accrued materials and maintenance problems. The present invention is cheaper and easier to practice than previously used commercial one-side coating methods. Existing in-line anneal type continuous coating lines can be easily and inexpensively modified to produce a one-side coated product in accordance with the present invention and, in fact, with provision for equipment interchangability the same line can be used to produce both a one-side and a two-side coated product as desired. Product quality is superior to that produced by other hot dip methods with respect to both the coated and the uncoated surfaces.

SUMMARY OF THE INVENTION

The invention relates to a method and means for continuously contact-coating with a molten coating metal one side only of a ferrous base metal strip. In a first embodiment, the strip is caused to pass above the surface of a bath of the molten coating metal. The strip passes about a first roll and the strip surface to be coated is caused to travel sufficiently close to the molten coating metal bath surface that the surface tension and wetting characteristics of the coating metal will permit the formation of a meniscus which will continuously contact and coat the strip surface. Initial coating of the strip surface is accomplished within a hood or snout provided with a protective, non-oxidizing atmosphere. While the surface being coated is still in contact with the molten coating metal meniscus, the strip is conducted out of the snout. Once out of the snout, the strip passes about a second roll and is conducted upwardly and away from the molten coating metal bath. The coated surface of the strip is finished by a jet knife. Means are provided to prevent the entrance of an oxidizing atmosphere into the snout.

A second embodiment of the invention differs from the first only in the provision of a small third roll between the first and second rolls and located outside of the hood or snout. This third roll deflects the flight of the strip between the first and second rolls slightly downwardly, permitting the first and second rolls to be located at a slightly greater distance from the molten coating metal bath surface to prevent splashing or roll pick up. The small third roll will normally be of a length less than the width of the strip being coated to prevent coating metal pick-up thereby.

In a third embodiment, the surface of the strip to be coated is caused to travel sufficiently close to the molten metal bath surface to permit the formation of a coating meniscus through the agency of a single roll which directs the strip surface to and through the meniscus and thereafter upwardly and away from the molten coating metal bath surface. Once again the coated surface is finished by a jet knife. In this embodiment, the single roll and the jet knife are both located within a snout filled with a protective atmosphere and the jet finishing in accomplished with a non-oxidizing or inert gas. In a similar fashion, the first two embodiments described above can be provided with an enlarged protective snout housing the jet finishing means as well as the first and second rolls in the first embodiment and the first second and third rolls in the second embodiment.

The teachings of the present invention are applicable to a line wherein the base metal strip has been subjected to a chemical surface preparation and at least that side of the strip to be coated by the molten coating metal has been coated with a flux. Again one or more roll means are provided to conduct the strip surface to be coated sufficiently close to the surface of the molten coating metal bath to permit the formation of a meniscus which will continuously contact coat the strip surface. The coating step is preferably followed by jet finishing.

In instances where the coated strip is subjected to an oxidizing atmosphere while the strip is sufficiently hot to cause the formation of visible oxide on its uncoated side, the strip will thereafter be subjected to acid cleaning, followed by rinsing and drying steps to remove the visible oxide. This acid cleaning can be accomplished in several ways, as will be described hereinafter.

Where the entire coating and finishing operations are accomplished within a protective atmosphere, the necessary acid cleaning may be eliminated by maintaining the strip within a protective atmosphere until it cools to a temperature at which a visible oxide will not be formed on its uncoated side when exposed to an oxidizing atmosphere. Means may be provided to accelerate cooling of the strip while still in a protective atmosphere, as will be described hereinafter.

BRIEF DESCRIPTION OF THE DRAWINGS

FIG. 5 is a fragmentary semi-diagrammatic cross sectional view similar to FIG. 1 and illustrating another embodiment of the present invention.

FIG. 6 is a semi-diagrammatic cross sectional view similar to FIG. 2, illustrating the coating apparatus of FIG. 1 or 5 without the use of a seal block.

FIGS. 11 through 14 are fragmentary semi-diagrammatic cross sectional views, similar to FIG. 7, and illustrating various methods and means by which the strip may be maintained in a protective, non-oxidizing atmosphere until it cools to a temperature such that, when exposed to an oxidizing atmosphere, no visible oxide will be formed on its uncoated side.

FIG. 15 is a fragmentary semi-diagrammatic cross sectional view illustrating yet another embodiment of the method and means of the present invnetion similar to the embodiment of FIG. 5, but wherein the entire coating and finishing operations are maintained within a protective atmosphere.

DESCRIPTION OF THE PREFERRED EMBODIMENTS

All of the embodiments of the present invention require that conventional strip preparation techniques be practiced prior to the coating. For example, the strip may be cleaned in a non-oxidizing preheater, annealed and cooled in a high temperature protective atmosphere. The precise nature of the strip preparation steps does not constitute a limitation on the present invention so long as at the time of coating the strip is at the proper temperature and its surfaces are clean and free of oxide. Suitable strip preparation techniques of this general type are taught, for example, in U.S. Pat. Nos. 2,110,893; 3,320,085; 3,837,790 and 3,936,543. Chemical strip preparation techniques of the type taught in U.S. Pat. Nos. 2,824,020 and 2,824,021, utilizing a flux, can also be employed, as will be described hereinafter.

Figures 1, 2, 3:
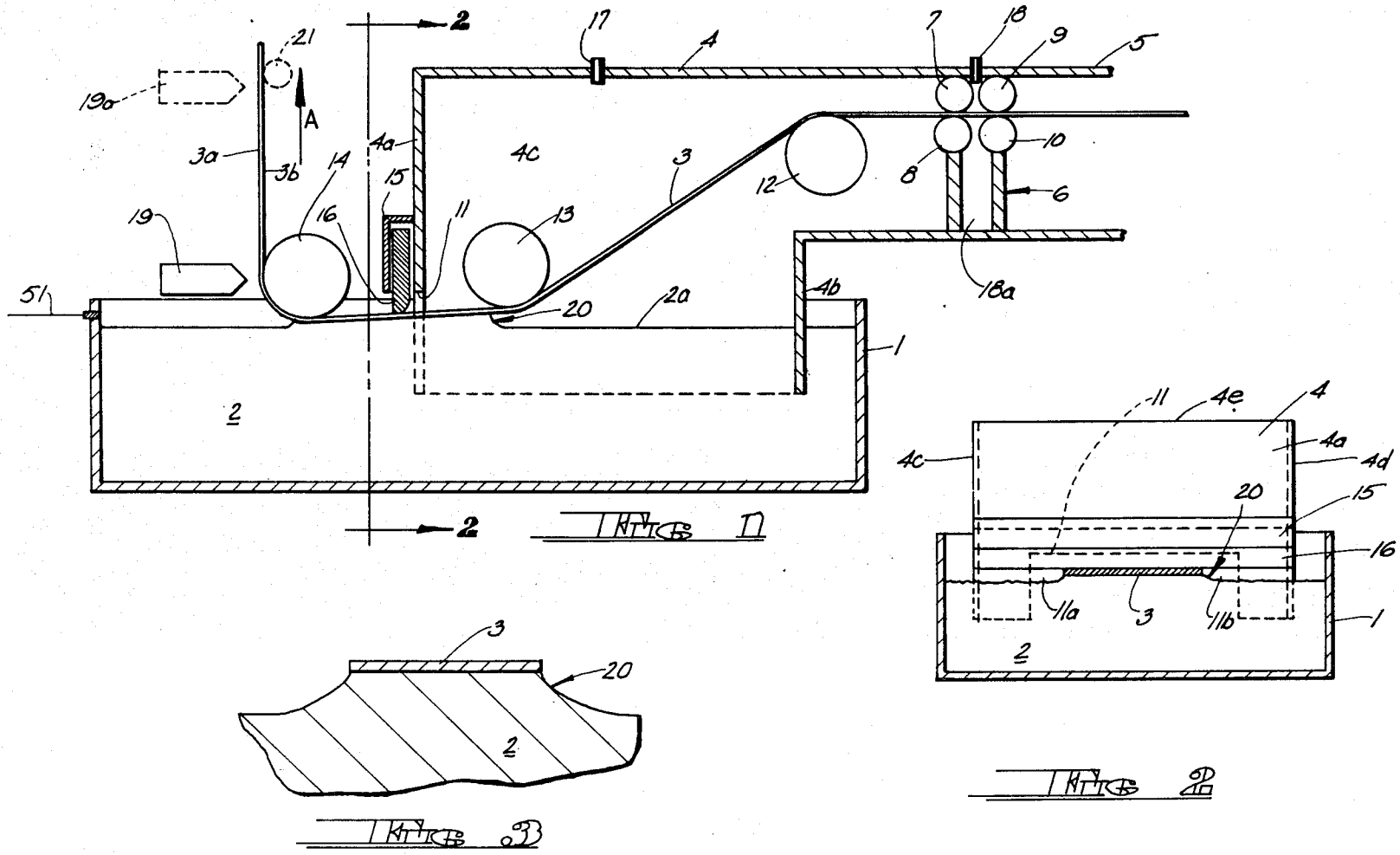
FIG. 1 is a fragmentary semi-diagrammatic cross sectional, elevational view of a first embodiment of the coating apparatus and method of the present invention.
FIG. 2 is a cross sectional view taken along section line 2—2 of FIG. 1.
FIG. 3 is a fragmentary semi-diagrammatic cross sectional view illustrating contact of the strip by the molten coating metal meniscus.

A first embodiment of the present invention is illustrated in FIGS. 1 through 3. A coating pot is shown at 1 containing a bath of molten coating metal 2. The ferrous base metal strip, one side of which is to be coated, is shown at 3. A snout 4 is provided constituting an extension of the hood (shown fragmentarily at 5) of the conventional strip preparation apparatus of the type taught in the above mentioned U.S. Pat. Nos. 2,110,893; 3,320,085; 3,837,790 and 3,936,543. The snout 4 may be an integral part of hood 5, or it may be connected thereto in gas-tight fashion. Preferably, there is a gas-tight seal generally indicated at 6 between snout 4 and hood 5. The seal 6 may take any appropriate form. For purposes of an exemplary showing, the seal 6 is illustrated as being made up of two pairs of sealing rolls 7–8 and 9–10.

Snout 4 comprises a forward wall **4*a*, a rearward wall 4*b*, side walls 4*c* and 4*d* and a top 4*e*. It will be evident from FIGS. 1 and 2 that the forward, rearward and side walls extend downwardly into the molten metal bath 2. Forward wall 4*a* has a U-shaped notch or opening 11 therein, a portion of which extends above the bath 2 and defines an exit for strip 3 from hood snout 4. The exit 11** should be of such width as to accommodate the widest ferrous base metal strip to be coated.

Strip 3 passes between the sealing rolls 9–10 and 7–8 to a roll 12 within snout 4. From roll 12 the strip passes to roll 13 which brings that surface of the strip to be coated near the upper surface **2*a* of the molten coating bath. From roll 13 the strip passes through snout exit 11 to roll 14 and thence upwardly and away from the molten coating metal bath 2. Rolls 12, 13 and 14** are appropriately supported by conventional means not shown.

The forward wall **4*a* of snout 4 may be provided with a bracket 15 adapted to receive an elongated panel-like block 16 of graphite or other suitable material which serves as a seal to close up the majority of snout exit 11. The graphite block 16 is free to move up and down within bracket 15 and rests on the upper or uncoated surface of ferrous base metal strip 3**.

It is important that snout 4 be provided with a non-oxidizing atmosphere so that the surfaces of strip 3 remain clean and oxide-free prior to coating. To this end, snout 4 has an inlet 17 through which an appropriate non-oxidizing gas is introduced into the snout. Any appropriate non-oxidizing gas may be used including nitrogen, inert gases or the like. The non-oxidizing atmosphere within snout 4 must be maintained at a slight positive pressure such that the ambient oxidizing atmosphere outside the snout cannot enter the snout through snout exit 11 and particularly those portions **11*a* and 11*b* (see FIG. 2) not closed by seal 16. In similar fashion it is preferable to provide a non-oxidizing atmosphere inlet 18 between sealing roll pairs 7–8 and 9–10. It is further preferable that the non-oxidizing atmosphere is subchamber 18*a* be at a pressure slightly higher than the pressure within snout 4 and higher than the pressure within hood 5. This insures that the non-oxidizing atmosphere within hood 5 cannot be contaminated even during shut down of the apparatus while work is being done within snout 4. Since the pressure of the non-oxidizing atmosphere within subchamber 18*a* is higher than the atmosphere pressure within hood 5, this will also prevent contamination of the atmosphere within hood 5 from sources at the entry end of the conventional strip preparation apparatus. Finally, the coated side of strip 3 will be finished with a jet knife 19**, about which more will be stated hereinafter.

The apparatus having been described, the operation may be set forth as follows. With the ferrous base metal strip 3 threaded between and about rolls 7–8, 9–10, 12, 13 14 as shown and moving in the direction of arrow A (FIG. 1), a slight ripple or wave may be made in the upper surface **2*a* of the molten coating metal bath 2. This will cause contact of the adjacent side of ferrous base metal strip 3 by the molten coating metal and the surface tension and wetting characteristics of the coating metal will cause the formation of a meniscus which will continuously contact and coat the adjacent strip surface. The meniscus is shown at 20 in FIGS. 1 through 3. By virtue of meniscus 20, continuous contact-coating of one side only of strip 3 may be accomplished without the necessity of dipping the strip into bath 2. Thus, strip 3 as it moves upwardly from roll 14 will have a coated side 3*a* and an uncoated side 3*b***.

It will be understood by one skilled in the art that for purposes of a clear showing in FIGS. 1 through 3 the thickness of strip 3, the distance of rolls 13 and 14 from the top surface **2*a* of bath 2 and the height of the meniscus have been exaggerated. The distance of that surface of strip 3 to be coated from the top surface 2*a* of bath 2** which will enable the formation and maintenance of a coating meniscus will vary somewhat with the coating metal used and its surface tension and wetting characteristics. Excellent results have been achieved with most coating metals when this distance has been maintained at about 5/16 of an inch or less.

It is preferable that roll 13 be located slightly higher above the upper surface **2*a* of the molten coating metal bath 2 than roll 14. Again, this height difference is exaggerated for purposes of clarity in FIG. 1. An actual height difference of from about $\frac{1}{8}$ inch to about $\frac{1}{4}$ inch is contemplated. The purpose of this height difference is simply to further insure against splash or roll pick up by roll 13 which is located beneath snout 4** and hence is not visible to the coating operator.

Jet knife 19 may be located at or slightly below the center line of roll 14. Just how far below the center line of roll 14 the jet knife may be located will depend primarily upon the diameter of the roll and the strip speed. It is important that the jet knife not blow a contaminating atmosphere through snout exit 11 or disturb meniscus 20. Jet knife 19 may be located above roll 14 as shown in broken lines at **19*a*. To assure proper jet finishing, it is important that the transverse cross section of the strip 3 remain flat. To this end, it is preferable that a back up roll (shown in broken lines at 21) be provided opposite jet knife 19*a***.

Figures 4, 5A, 5B, 5D:
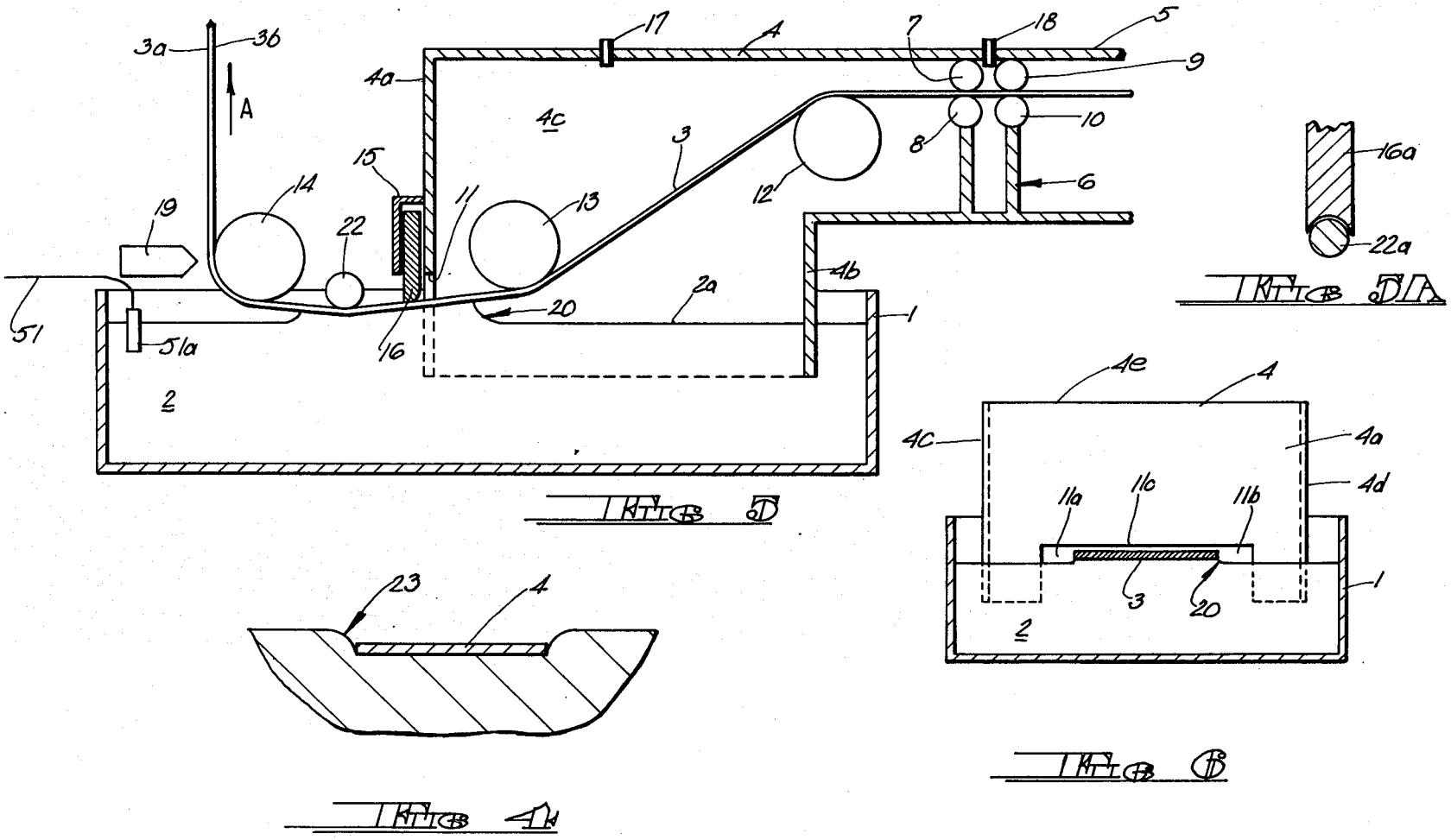
FIG. 4 is a fragmentary semi-diagrammatic cross sectional view, similar to FIG. 3, but illustrating the types of meniscus which may occur when aluminum is used as the molten coating metal.
FIG. 5*a* is a fragmentary cross sectional view illustrating the combination of the seal block and third roll of FIG. 5.

Another embodiment of the present invention is illustrated in FIG. 5. This embodiment is similar to the embodiment of FIG. 1 and like parts have been given like index numerals. The embodiment of FIG. 5 differs only in the provision of roll 22 located outside of snout 4 and between rolls 13 and 14. Roll 22 will be provided with appropriate support means (not shown) and is so located as to deflect that flight of strip 3 between rolls 13 and 14 slightly downwardly. This will permit rolls 13 and 14 to be raised slightly from the top surface **2*a* of the molten coating metal bath 2 to assure against splashing or coating metal pick up by these rolls. Roll 22 should be of a length slightly less than the width of the strip 3 being run. As in the case of FIGS. 1 through 3, the thickness of strip 3, the height of meniscus 20 and the distance of rolls 13 and 14 from the top surface 2*a* of the molten coating metal bath 2 have been exaggerated in FIG. 5 for purposes of clarity. The amount of deflection imparted in strip 3 by roll 22 has also been exaggerated. The amount of deflection is contemplated as being from about ¼ inch to about ½ inch enabling the location of rolls 13 and 14 a like amount higher from the top surface 2***a* of the bath than in the embodiment shown in FIG. 1. In all other ways the apparatus of FIG. 5 and its operation may be substantially identical to that of FIG. 1. The meniscus formed is the same as that shown in FIG. 3. The meniscus will be the same with the use of any appropriate coating metal. However, it has been found that when aluminum is used as a coating metal, while the meniscus will normally be of the form shown in FIG. 3, the roll 22 can actually depress the strip 3 slightly beneath the surface 2*a* of the molten coating metal bath 2 since aluminum will form a meniscus of the type shown at 23 in FIG. 4. Thus, with aluminum as the molten coating metal, the strip may actually pass slightly below the surface of the molten coating bath and one-side coating will still be achieved.

The embodiment of FIG. 5 may be modified by supporting roll 22 on seal block 16. This is shown in FIG. 5*a* wherein roll 22*a* (equivalent to roll 22 of FIG. 5) is rotatively supported on seal block 16*a* (equivalent to seal block 16 of FIG. 5) by conventional means (not shown). Roll 22*a* lies along the bottom edge of seal block 16*a* and will contact the uncoated side 3*b* of strip 3 to serve the same purpose described with respect to roll 22 in FIG. 5. it is also within the scope of the invention to locate roll 22 of FIG. 5 within snout 4, requiring only the proper positioning of rolls 13 and 14 to accommodate this change.

FIG. 6 is similar to FIG. 2 (like parts having been given like index numerals) and may be considered to be a cross sectional view illustrating the forward wall 4*a* of snout 4 of either FIG. 1 or FIG. 5. FIG. 6 differs from FIG. 2 in that bracket 15 and graphite seal 16 have been eliminated and the notch forming the snout exit 11*c* has been lowered to a position just above the strip 3 to minimize the exit opening. Thus, in the embodiments of FIGS. 1 and 5 the graphite seal 16 and bracket 15 may be eliminated, the entrance of an oxidizing atmosphere through exit 11*c* being prevented by maintaining the non-oxidizing atmosphere within hood 4 at a slight positive pressure.

Figure 7:
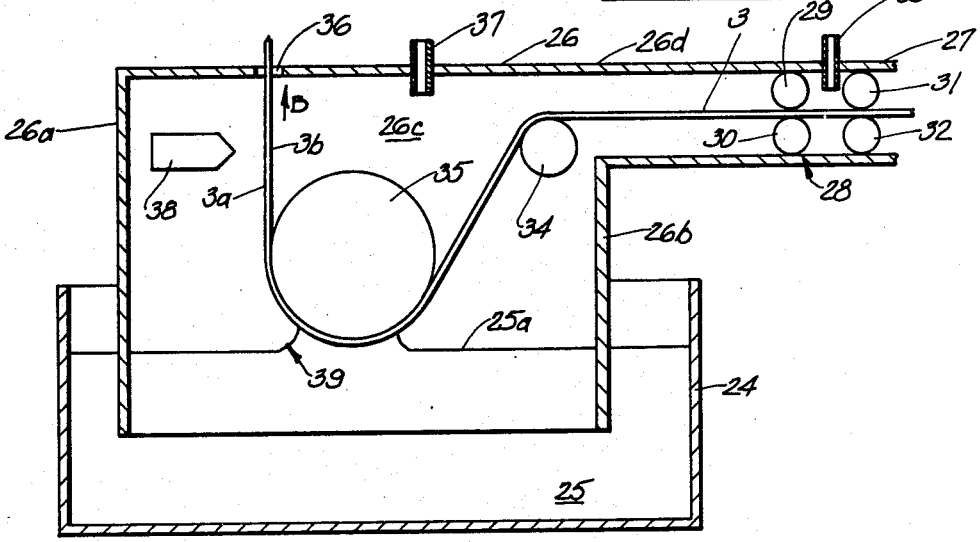
FIG. 7 is a fragmentary semi-diagrammatic cross sectional view of yet another embodiment of the coating method and apparatus of the present invention.

Another embodiment of the present invention is illustrated in FIG. 7. In FIG. 7 a coating pot 24 is shown containing a molten coating metal bath 25. A snout 26 is shown constituting a continuation of the strip pre-treatment hood fragmentarily shown at 27. Again the snout may constitute an integral part of pre-treatment hood 27 or may be connected thereto in a gas-tight fashion. A seal, generally indicated at 28 is provided between snout 26 and hood 27. The seal may take any appropriate form and, for purposes of an exemplary showing, is again illustrated as comprising a two pairs of sealing rolls 29–30 and 31–32. An inlet for a non-oxidizing atmosphere may be located between the roll pairs as at 33. Hood 26 has a forward wall 26*a*, a rearward wall 26*b* and side walls, one of which is shown at 26*c*. The forward, rearward and side walls of hood 26 extend downwardly into the molten coating metal bath 25.

The ferrous base metal strip is again indicated by index numeral 3 and passes between rolls 31 and 32 and rolls 29 and 30 of the seal. Thereafter, it passes over turn down roll 34 and about roll 35 which brings the surface of the strip to be coated near the top surface 25*a* of molten coating metal bath. Roll 35 thereafter directs the coated strip upwardly away from molten coating metal bath 25 and the strip exits snout 26 through an exit slot 36.

Snout 26 is provided with an inlet 37 for a non-oxidizing atmosphere and the non-oxidizing atmosphere is maintained within the snout at a slightly positive pressure such that the ambient oxygen-containing atmosphere outside the snout will not enter via exit slot 36. The seal 28 and its inlet 33 for a non-oxidizing atmosphere may serve the same purpose as described with respect to seal 6 and inlet 18 of FIG. 1. Again, seal 28 and inlet 33 are of particular importance during shut down of snout 26. In the embodiment of FIG. 7 a jet knife 38 is provided within snout 26. Jet knife 38 will operate with a non-oxidizing gas which may be the same as the non-oxidizing atmosphere within the snout.

The operation of the embodiment of FIG. 7 differs from the embodiments of FIGS. 1 and 5 primarily in that the entire coating and finishing operations are conducted within snout 26 and its protective, non-oxidizing atmosphere. With the ferrous base metal strip 3 threaded in the manner illustrated in FIG. 7 and moving the direction of arrow B, a small ripple made in the surface 25*a* of the molten coating metal bath 25 will again result in the formation of a meniscus 39 by which that surface of strip 3 facing the upper surface 25*a* of the molten metal bath will be continuously contact-coated as it passes about roll 35. The mounting means (not shown) within snout 26 for rolls 34 and 35 and for jet knife 38 may be conventional. As the ferrous base metal strip passes upwardly toward exit slot 36, it will be coated on the side 3*a* and uncoated on the side 3*b*. The coated side will be finished by jet knife 38 which again may be located at any position so long as it does not distrub meniscus 39 and the upper surface 25*a* of the molten coating bath 25. If convenience requires that the jet knife 38 be located upwardly from roll 35 by a distance such that it might cause distortion of the transverse shape of strip 3, a back up roll may be provided, as has been described with respect to FIG. 1, to assure that the transverse cross section of the strip remains flat during the finishing operation.

In all of the embodiments thus far described, the strip 3 will be exposed to the ambient atmosphere while still at a temperature sufficiently elevated to result in the formation of a visible oxide on the uncoated side 3*b* thereof. For short exposure times, the visible oxide coating is made up of thin oxide layers or films, the film adjacent the base metal being made up primarily of FeO, surmounted by a film of $Fe_3O_4$ followed, in turn, by a layer of $Fe_2O_3$. If the temperature of the strip when exposed to an oxidizing atmosphere is below about 1055° F., the FeO layer will not form, which is normally the case when the molten coating metal is zinc. When the molten coating metal is aluminum the temperature of the strip will normally be above 1055° F. and a FeO layer will be formed.

The visible oxide coating can be removed by an acid cleaning process, as previously mentioned. The term "acid cleaning process" is purposefully used here, as distinguished from "acid pickling". The distinction between acid cleaning and acid pickling is a matter of degree, acid pickling normally referring to a severe treatment for the removal of scale from a semi-finished product. The first phase of an acid cleaning process is purely chemical and comprises the dissolution of the oxide films. The oxide films dissolve at differing rates, the dissolution of the $Fe_3O_4$ film being rate controlling since it is the slowest to dissolve. Thin, porous oxide films can be removed by acid penetration and direct base metal attack. The oxide removal rate can be increased in several ways. First of all, the chemical reaction rate can be increased by raising the temperature of the acid bath or increasing the acid concentration. In addition, the rate of oxide removal by penetration can be increased by imposing an electric current. This increases base metal dissolution and local surface agitation by hydrogen generation.

The acid cleaning of a one-side coated base metal strip offers a unique problem in that it is desirable to remove the oxide from the uncoated side of the ferrous base metal strip while at the same time minimizing etching of the coated side. It has been determined that an electrolytic acid cleaning process is preferred.

Acid cleaning involves a number of interrelated variables which make for an almost infinite number of specific combinations of these variables, each capable of adequately removing the visible oxide film from the uncoated side of the strip. Nevertheless, basic guide lines can be established for preferred acid cleaning of a one-side coated base metal strip.

The basic variables of acid cleaning include the acid used, acid concentration, acid temperature, electrode-strip distance, strip immersion time and current density through the electrode. To minimize etching of the coated side of the strip a dilute acid solution is preferred, generally 1% commercial acid by volumn or less. The type of acid used will be determined by its effectiveness, cost, availability, pollution control requirements and ventilation requirements. Among the common acids for this purpose, sulfuric, phosphoric, hydrochloric and nitric acids can all be used effectively. Sulfuric and phosphoric acids are slightly more efficient and sulfuric acid is preferred not only by virtue of its effectiveness, but also because of its reduced fuming tendencies.

Acid temperature should be kept low (below about 100° F.) if etching and staining of the coated side of the strip are to be minimized. The electrode-strip distance should be minimized to increase efficiency. However, electrode distance will be determined by continuous passline requirements needed to avoid strip-electrode contact. The strip immersion time should also be minimized to that time required to just remove the particular visible oxide present. From a practical standpoint, however, the strip immersion time will be fixed by tank dimensions and strip operating speeds. There will be a minimum current density needed for a given installation. The range of 200 to 400 amps. per square foot has proven to be quite adequate. Increasing the current density much above the practical minimum would simply be useless and wasteful.

Figure 8:
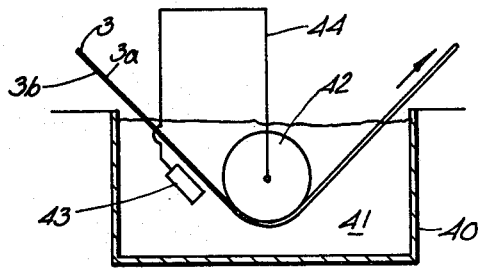
FIG. 8 is a fragmentary semi-diagrammatic cross sectional view illustrating a first method and apparatus for acid cleaning.

FIG. 8 illustrates a modified galvanic cell approach by which the acid cleaning step may be performed. In FIG. 8 a vat 40 is illustrated containing a dilute acid bath 41. The strip 3 with its coated side 3*a* and uncoated side 3*b* is caused to pass through bath 41 about roll 42 supported within the bath by conventional means (not shown). A block 43 of sacrificial metal (such as zinc) is located in close proximity to the uncoated side 3*b* of the ferrous base metal strip 3 and is maintained in position by appropriate holding means (not shown). The block of sacrificial metal 43 is electrically connected to the ferrous base metal strip as at 44 and via roll 42. Although the base metal attack rate is not increased, rapid hydrogen generation at the uncoated surface of strip 3 helps agitate the oxide therefrom. Hydrogen is also generated at the sacrificial metal block 43 and rises to help agitation of the oxide on the uncoated strip surface 3*b*. Other sacrificial metals can be used including magnesium and aluminum.

In actual test runs, both 0.5% sulfuric acid and 0.5% phosphoric acid were used as the dilute acid bath 41 and were maintained at a temperature of about 90° F. The strip 3 was coated on side 3*a* with zinc and had an oxide coating on side 3*b* formed as a result of the strip exiting from the protective atmosphere of the coating operation into air at a strip temperature of about 900° F. A sacrificial block 43 of zinc was used and was maintained about ⅛ inch from strip surface 3*b*. The oxide coating was removed from surface 3*b* in about 3 seconds with no evidence of etching of the zinc coating on strip side 3*a*.

Figure 9:
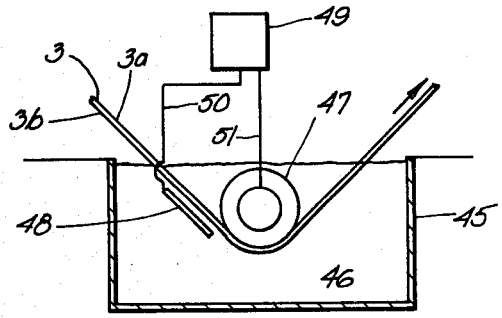
FIG. 9 is a fragmentary semi-diagrammatic cross sectional view, similar to FIG. 8, illustrating a second method and apparatus for acid cleaning.

FIG. 9 illustrates another method and apparatus for acid cleaning the strip 3 having a hot metal coated side 3*a* and an oxide coated side 3*b*. In this embodiment, a vat 45 is provided containing a dilute acid bath 46. The strip 3 is caused to pass about a submerged roll 47 and an electrode 48 is located adjacent the uncoated strip side 3*b*. The electrode and the strip (via roll 47) are connected to a source of current 49 as at 50 and 51, respectively.

It has also been found that instead of connecting the lead 51 from current source 49 to roll 47 (or to a sliding contact or contact rolls as is known in the art), the molten coating metal bath may be used to impart electric current to the strip eliminating possible surface damage to the strip by scratching or electric arcing. To this end, lead 51 from current source 49 may be connected to coating pot 1 when the coating pot is made of metal. For purposes of an exemplary showing, this has been illustrated in FIG. 1. Alternatively, lead 51 may be connected to an electrode 51*a* immersed in the molten coating metal bath. For purposes of an exemplary showing this has been illustrated in FIG. 5. It will be understood that the connections of lead 51 illustrated in FIGS. 1 and 5 could be used in any of the coating embodiments described herein when acid cleaning of the type described with respect to FIG. 9 is to be employed.

The embodiment of FIG. 9, wherein a current is imposed from an external source 49, has been found to be more efficient than the embodiment of FIG. 8. Iron dissolution below the oxide layer is accelerated with some hydrogen generation to assist in agitating the oxide off of the ferrous base metal strip 3. The current source 49 may be either AC or DC, with AC being preferred due to the current pulsation which increases the rate of the acid cleaning process. The electrode 48 may be any appropriate material which is conductive and not attacked by the dilute acid bath 46. Stainless steel is an excellent electrode material. Other materials such as platinum or lead could be used for electrode 48.

In an actual test run the dilute acid bath 46 comprised 0.5% sulfuric acid maintained at a temperature of about 90° F. Power source 49 was a DC welding generator providing a current flow of approximately 110 amperes with the strip 3 constituting the cathode and electrode 48 constituting a stainless steel anode. The strip 3 had an oxide film on side 3*b* formed by the strip exiting the non-oxidizing protective atmosphere of the coating operation into air at a strip temperature of about 900° F. The oxide film was removed in less than 6 seconds with rapid hydrogen evolution at both the electrode 48 and the strip surface 3*b*. No staining of the zinc coating on strip side 3*a* was observed for immersion times less than 4 seconds. Some light staining and etching of the zinc coating was noted for immersion times of 6 seconds. The stainless steel electrode was located about ½ inch from strip side 3*b*.

In another test run the dilute acid bath 46 was again 0.5% sulfuric acid maintained at about 80° F. and the electrode was again stainless steel. The strip 3 had a zinc coating on side 3*a* and an oxide coating on side 3*b* formed by the strip exiting the protective atmosphere of the coating operation into air at a strip temperature of about 900° F. Power source 49 was an AC source providing a current of approximately 9 amperes. Electrode 48 was maintained approximately 1 inch from strip surface 3*b*. Under these conditions the oxide film was removed in about 2 seconds. No etching of the zinc coating on strip surface 3*a* was noted.

Figure 10:
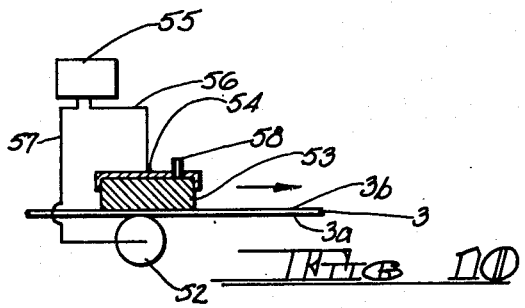
FIG. 10 is a fragmentary semi-diagrammatic cross sectional view illustrating a third method and apparatus for acid cleaning.

A variation of the embodiment of FIG. 9 is illustrated in FIG. 10 wherein the strip is again indicated at 3 with its metal coated side 3*a* and oxide coated side 3*b*. In this embodiment, the strip 3 passes over a support roll 52 and the bath 46 of FIG. 9 has been replaced by a dilute acid-laden sponge 53. Sponge 53 is supported by a holding means 54 which may be made of stainless steel or other material not attacked by or embrittled by the dilute acid used. The sponge 53 and its holder 54 are connected to a current source 55 as at 56. The strip 3 is also connected to the current source via roll 52 as at 57. The current source 55 may be either AC or DC. An inlet means 58 is provided in sponge holder 54 by which acid replenishment may be accomplished. The embodiment of FIG. 10 is characterized by the advantage that no vat is required and the sponge 53 does provide an oxide-removing scrubbing action. Care must be taken to replace the sponge as required by wear thereof or the sufficient accumulation of particles embedded in the sponge to present a scratching hazard to the strip 3.

All of the acid cleaning procedures described above must be followed by appropriate rinsing and drying steps (well known in the art) to limit the acid attack on both sides of the strip. Appropriate dilute acids other than those enumerated above may be used and the selection of a preferred dilute acid is well within the skill of the worker in the art. The dilute acids used may include normal additives such as surfactants, inhibitors, antifoaming agents and the like, all as is well known in the art.

Figure 11:
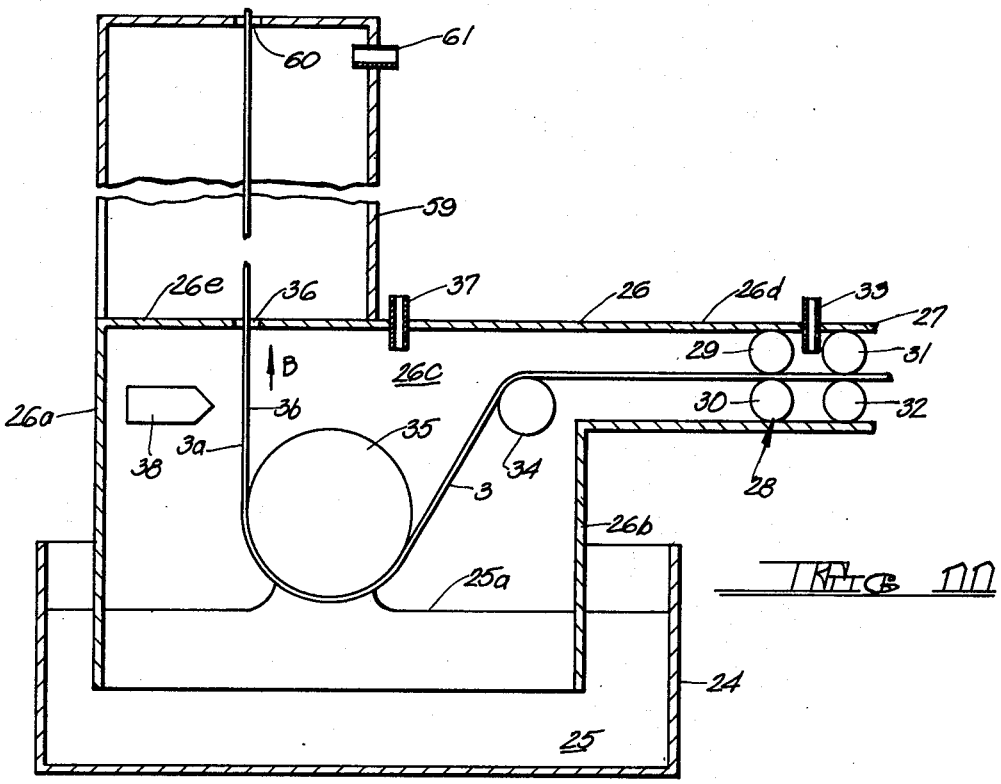

The acid cleaning, rinsing and drying steps may be eliminated if the one-side coated ferrous base metal strip is maintained in protective, non-oxidizing atmosphere until it attains a temperature sufficiently low to preclude the formation of a visible oxide coating on its uncoated side. This method and an apparatus therefor is illustrated in FIG. 11. For purposes of an exemplary showing, the coating method and apparatus of FIG. 11 is identical to that of FIG. 7 and like parts have been given like index numerals. The embodiment of FIG. 11 differs from that of FIG. 7 only in that a cooling hood 59 has been added to snout 26 in the area of snout exit 36. Cooling hand 59 is provided with an exit 60. The cooling hood is of such length that by the time the strip 3 passes through hood exit 60 it will have cooled down to a temperature of about 300° F., i.e., a temperature at which no visible oxide will form on the uncoated side 3*b* of the strip. The cooling hood 59 will of course be provided with a non-oxidizing atmosphere which will enter hood 59 through snout exit 36. If required, an additional inlet for such a non-oxidizing atmosphere may be provided in cooling hood 59 at 61. While for purposes of an exemplary showing the cooling hood 59 is illustrated as simply having been added to snout 26, it will be understood that that portion 26*e* of snout top 26*d* located beneath hood 59 and including snout exit 36 may be eliminated. With the exception of maintaining the coated strip in a protective atmosphere until it has sufficiently cooled to prevent the formation of a visible oxide on its uncoated side, the operation of the embodiment of FIG. 11 is identical to that described with respect to FIG. 7.

Figure 12:
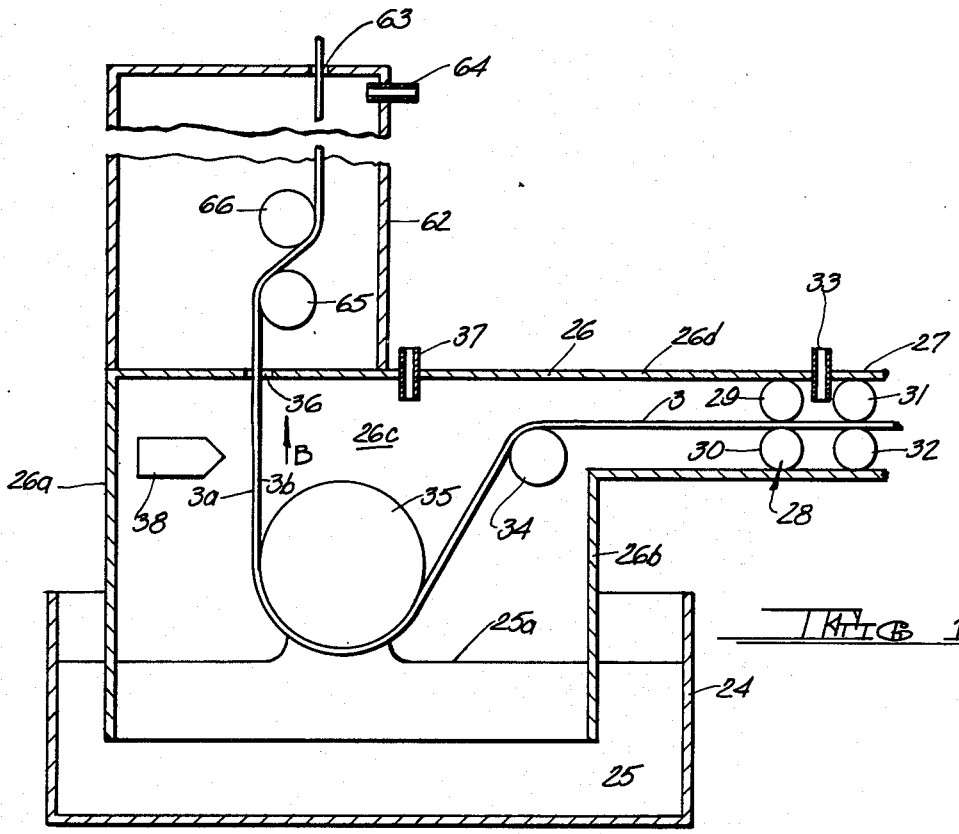
Figure 3:
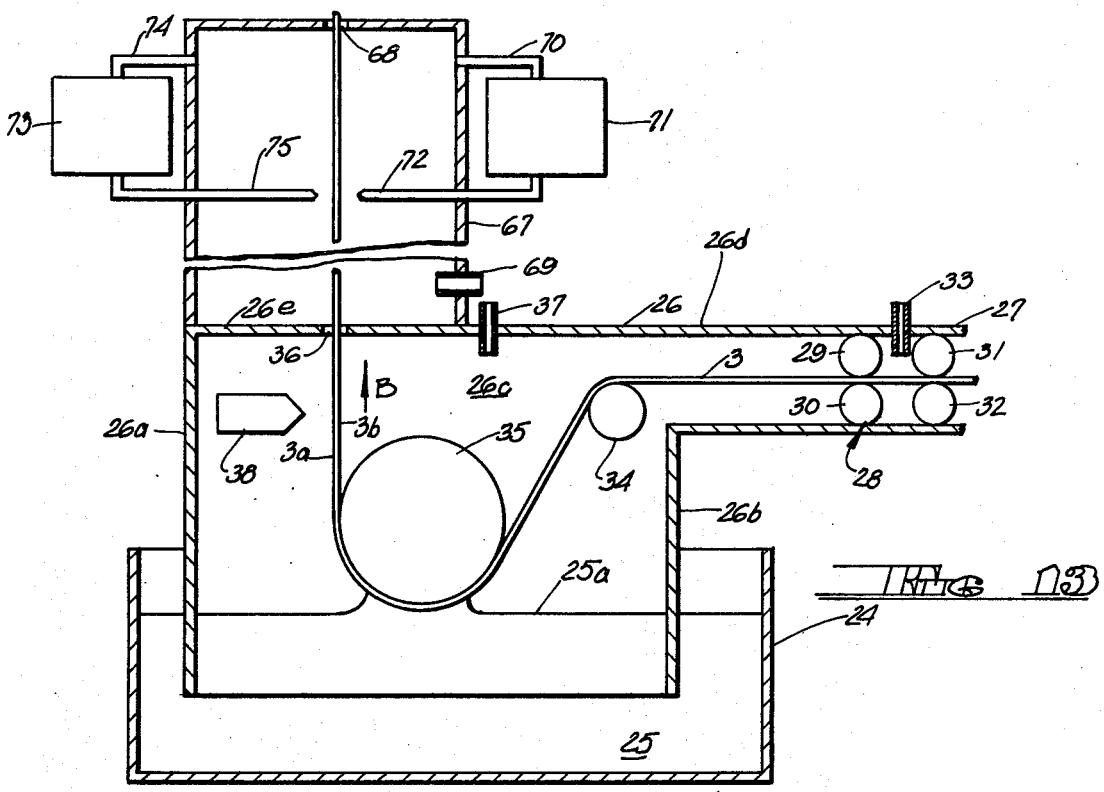
Figure 4:
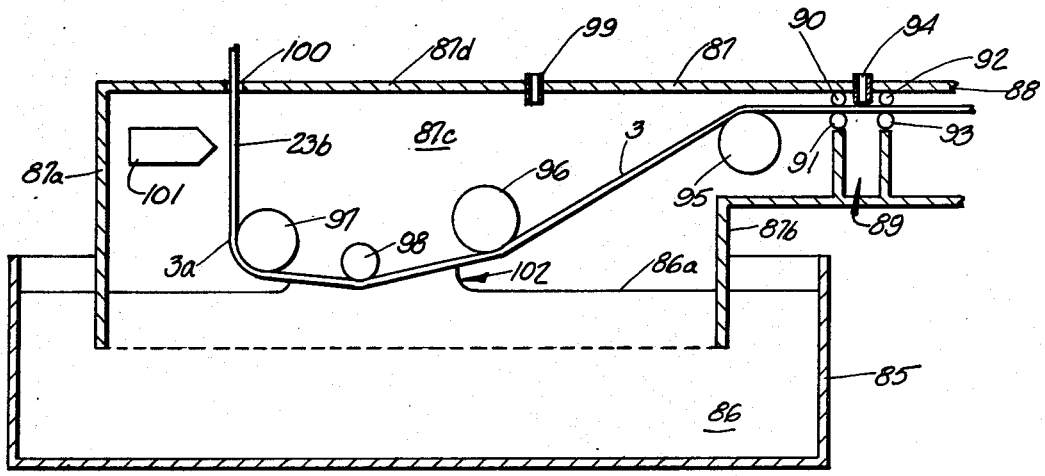

The length of the cooling hood required to maintain the coated strip in a protective atmosphere until the strip reaches a temperature at which a visible oxide will not be formed on its uncoated side may be lessened by providing means to increase the cooling rate of the strip. FIG. 12 illustrates an embodiment substantially identical to FIG. 7 and again like parts have been given like index numerals. In FIG. 12 a cooling hood 62 is provided similar to hood 59 of FIG. 11 and having an exit 63 and an additional inlet 64 for non-oxidizing atmosphere, if needed. In this embodiment, however, the strip 3 is caused to pass about chilled rolls 65 and 66 which cause a reduction in the temperature of the strip, thereby enabling cooling hood 62 to be shorter. Again, that portion 26*e* of snout top 26*d* which lies beneath cooling hood 62 and includes exit 36 can be eliminated.

Another way in which the strip may be protected from the formation of a visible oxide is illustrated in FIG. 13. Again, the apparatus is substantially identical to that of FIG. 7 and the coating operation is performed in the same manner. In this embodiment the snout 26 is provided with a cooling hood 67 having an exit 68. A protective atmosphere will be provided in hood 67 from snout 26 and an additional inlet for such an atmosphere may be provided at 69, if needed. In this embodiment a portion of the protective atmosphere is withdrawn from the cooling hood via outlet 70 to a heat exchanger diagramatically indicated at 71 and incorporating a fan or the like. The cooled protective atmosphere from heat exchanger 71 is reintroduced into cooling hood 67 via jet 72 which causes the cooled protective atmosphere to impinge upon the strip 3. To increase the strip cooling effect, a second heat exchanger 73 may be provided having an inlet 74 and a jet 75 diametrically opposed to jet 72. The provision of diametrically opposed jets 72 and 75 will assure that the flat cross sectional configuration of the strip 3 will be maintained. The heat exchangers 71 and 73 will enable a shortening of hood 67, as compared to the hood 59 of FIG. 11, since the cooling of strip 3 will be accelerated.

Figure 14:
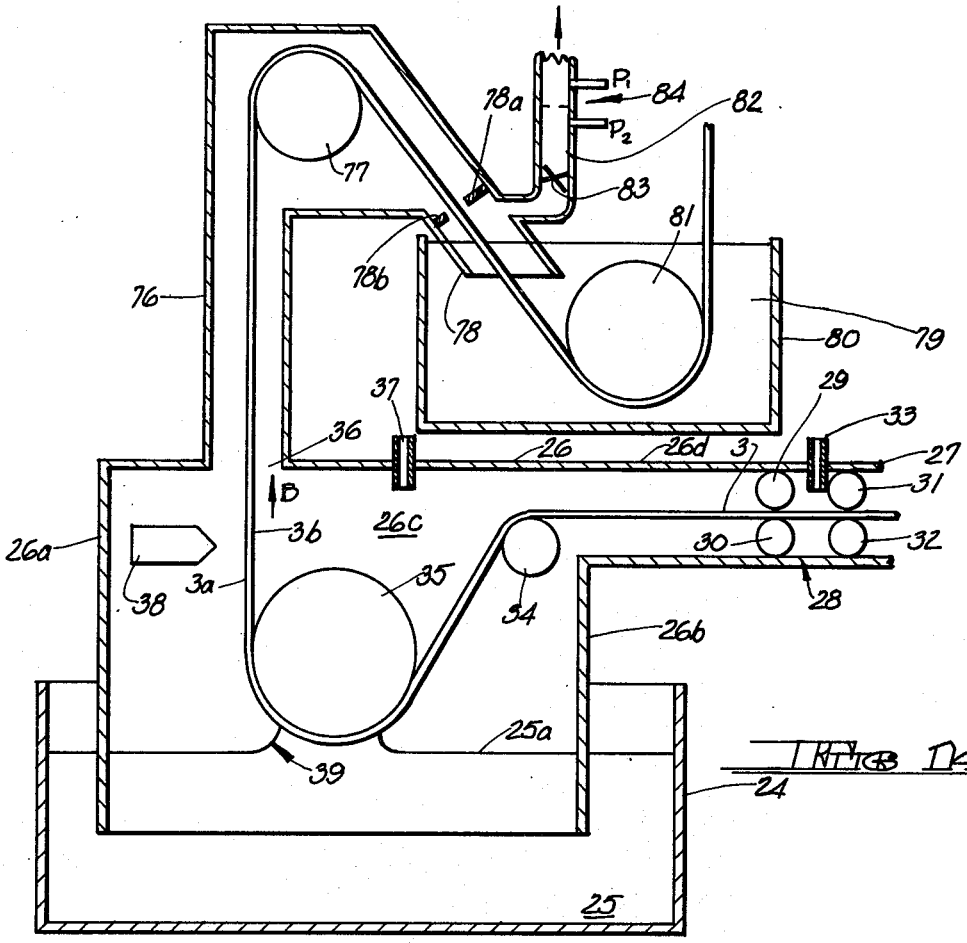

Yet another strip cooling means is illustrated in FIG. 14. In this embodiment once again the coating method and apparatus are identical to that of FIG. 7 and like parts have been given like index numerals. The embodiment of FIG. 14 is based upon the determination that the one-side coated strip can be quenched in a water bath without the formation of a visible oxide film on its uncoated side. To this end, a hood 76 is provided extending upwardly from the top 26*d* of snout 26. At its upper end the hood is provided with a guide roll 77 and terminates in an exit snout 78. Snout 78 is located beneath the surface of a water bath 79 in an appropriate vat 80. The strip 3 exits snout 26 via snout exit 36 and enters hood 76. Within hood 76 the strip passes about guide roll 77 and exits from snout 78 into water bath 79. The strip is guided through water bath 79 and is directed upwardly out of the water bath by a submerged roll 81. The snout portion 78 of hood 76 is provided with an outlet 82 for the non-oxidizing, protective atmosphere within hood 76 and water vapor brought about by immersion of the strip 3 into water bath 79. Outlet 82 is provided with a control valve 82 and the flow through outlet 82 may be monitored by an orifice meter (well known in the art) generally indicated at 84. Baffles 78*a* and 78*b* may be provided in snout portion 78 to minimize back-diffusion of water vapor into hood 76. It will be understood that the nonoxidizing, protective atmosphere within hood 76 will come from snout 26 via snout exit 36.

In all of the embodiments of FIGS. 11 through 13 the protective atmosphere within the cooling hood must be maintained at a pressure sufficient to prevent the entrance of the ambient oxidizing atmosphere into the cooling hood via the cooling hood exit.

FIG. 15 illustrates a modification of the embodiment of FIG. 5 wherein both the coating and finishing operations are conducted within a protective atmosphere. To this end a molten metal pot 85 is provided containing a molten coating metal bath 86. A snout 87 is connected to or forms an integral part of the pretreatment hood (fragmentarily shown at 88). Once again, a seal generally indicated at 89 may be provided between snout 87 and hood 88 serving the same purpose as seal 6 of FIG. 5. Again, for purposes of an exemplary showing the seal 89 is illustrated as being made up of pairs of sealing rolls 90-91 and 92-93 with a non-oxidizing atmosphere inlet 94 therebetween, serving the same purpose as inlet 18 of FIG. 5. The ferrous base metal strip is again indicated at 3 and is caused to pass about a turn down roll 95 equivalent to roll 12 of FIG. 5. Strip 3 also passes beneath rolls 96, 97 and 98 which are equivalent to and serve the same purpose as rolls 13, 14 and 22 of FIG. 5, respectively. The hood 87 has a forward wall 87*a*, a rearward wall 87*b* and side walls, one of which is indicated at 87*c*. These forward, rearward and side walls extend partway into the molten coating metal bath 86, as is shown. The top 87*d* of snout 87 is provided with a non-oxidizing atmosphere inlet 99 and an exit 100 for the strip 3. A jet knife 101 is mounted within hood 87 and may be located at any position within the hood so long as it does not disturb meniscus 102. A back up roll or jet knife (not shown) may be provided for jet knife 101 as was described with respect to FIG. 1.

The operation of the embodiment of FIG. 15 is identical to that of FIG. 5 and strip 3 will be provided with a coated side 3*a* and an uncoated side 3*b*. The embodiment of FIG. 15 differs from that of FIG. 5 primarily in that both the coating and jet finishing operations are conducted within the snout 87 and its protective atmosphere, eliminating the need for seal block 16 of FIG. 5. The one-side coated strip may pass through snout exit 100 to the ambient atmosphere whereupon it will be subjected to appropriate acid cleaning, rinsing and drying steps as described above. Alternatively, the strip may be maintained in a protective atmosphere (until it attains a temperature at which a visible oxide will no longer be formed on its uncoated side 3*b*) by any of the means illustrated in FIGS. 11 through 14. In the embodiment of FIG. 15 roll 98 could be eliminated. The result of this would be an embodiment similar to that of FIG. 1 but with both the coating and finishing steps performed within the snout.

Figure 16:
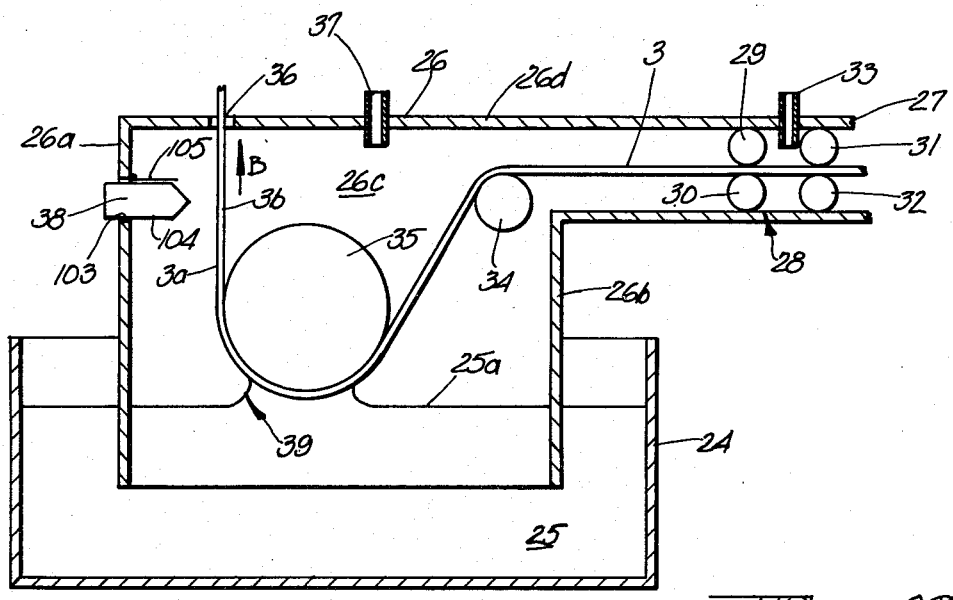
FIGS. 16 and 17 are fragmentary semi-diagrammatic cross sectional views similar to FIG. 7 and illustrating alternate jet knife arrangements.

FIG. 16 illustrates an embodiment similar to that of FIG. 7 and like parts have been given like index numerals. The coating operation in the embodiment of FIG. 16 is again identical to that described with respect to FIG. 7. FIG. 16 differs from FIG. 7 in that the forward wall 26*a* of snout 26 is provided with an opening 103 so sized as to just nicely accept jet knife 104 with its forward end located within snout 26 and its rearward end extending outside the snout. The opening 103 may be provided with a hinged closure 105 which rests on top of snout 104 when the snout is in place and which closes opening 103 to prevent entrance of an oxidizing atmosphere through opening 103 when the jet knife 104 is removed for cleaning. Additional support means (not shown) may be provided for jet knife 104 and may be conventional in nature. The opening 103 may be provided with a sealing gasket (not shown) or other sealing means to prevent contamination of the protective atmosphere within the snout by an external oxidizing atmosphere passing through opening 103 and about the jet knife. If opening 103 is closely sized to the peripheral dimensions of jet knife 104, such sealing means may be obviated by the positive pressure of the protective atmosphere maintained within snout 26. The arrangement of FIG. 16 may be applied to any of those embodiments described above having the jet knife located within the snout. This arrangement greatly facilitates periodic cleaning of the jet knife.

Figure 17:
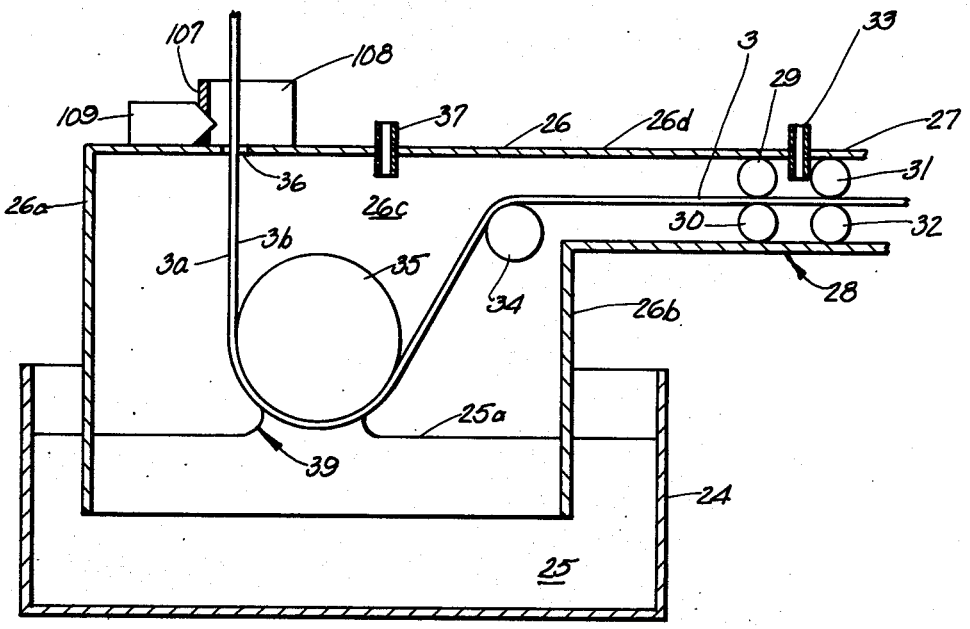
Figure 18:
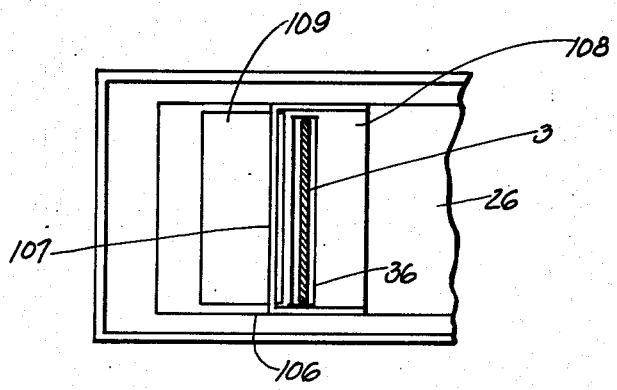
FIG. 18 is a fragmentary plan view of the structure of FIG. 17.

In those coating embodiments described above wherein the jet knife is located within the snout, under some circumstances a problem of coating metal dust formation from coating metal vapor formed in the jet finishing operation can arise. Also, a problem of coating metal specks appearing on the uncoated surface of the strip may be encountered. The coating metal specks are again a result of the finishing operation, the specks blowing off the strip edges. FIGS. 17 and 18 illustrate a jet knife arrangement which will eliminate these problems. For purposes of an exemplary showing FIG. 17 illustrates a coating apparatus identical to that of FIG. 7 and like parts been given like index numerals. It will be understood that the snout arrangement of FIGS. 17 and 18 can be applied to the coating apparatus of FIG. 15 (with or without roll 88) in precisely the same manner.

In FIGS. 17 and 18 the exit slot 36 of hood 26 is surrounded on three sides by walls or baffles 106, 107 and 108. Jet knife 109 is mounted outside snout 26 with its forward end extending through baffle 107. With this arrangement, and with a non-oxidizing gas used in jet knife 109, the zinc coating on side 3*a* of strip 3 will be finished before it is exposed to the surrounding air atmosphere. Any coating metal dust or specks formed will be blown harmlessly away from the uncoated side 3*b* of the strip. Where ambient conditions warrant, another baffle or top (not shown) may extend across the top edges of baffles 106 through 108. Such a top will be provided with a slot through which the strip 3 may travel. The top will eliminate any unfortunate down draft currents which might be created by the finishing action. That side of the baffle system opposite uncoated strip side 3*b* will still be open enabling coating metal dust or specks to be blown clear of uncoated strip side 3*b*.

As indicated above, the process and apparatus of the present invention are not limited to the use of any particular pretreatment of the ferrous base metal strip. For purposes of an exemplary showing the embodiments thus far described have been set forth in terms of conventional strip preparation techniques of the type taught in the above mentioned U.S. Pat. Nos. 2,110,893; 3,320,085; 3,837,790 and 3,936,543. When such conventional strip preparation techniques are used, it is necessary that the base metal strip be maintained in a protective atmosphere at least until contact of the side to be coated with the meniscus is achieved. Such a protective atmosphere is not a requirement when chemical strip preparation techniques of the type taught in U.S. Pat. Nos. 2,824,020 and 2,824,021 are employed.

Figure 19:
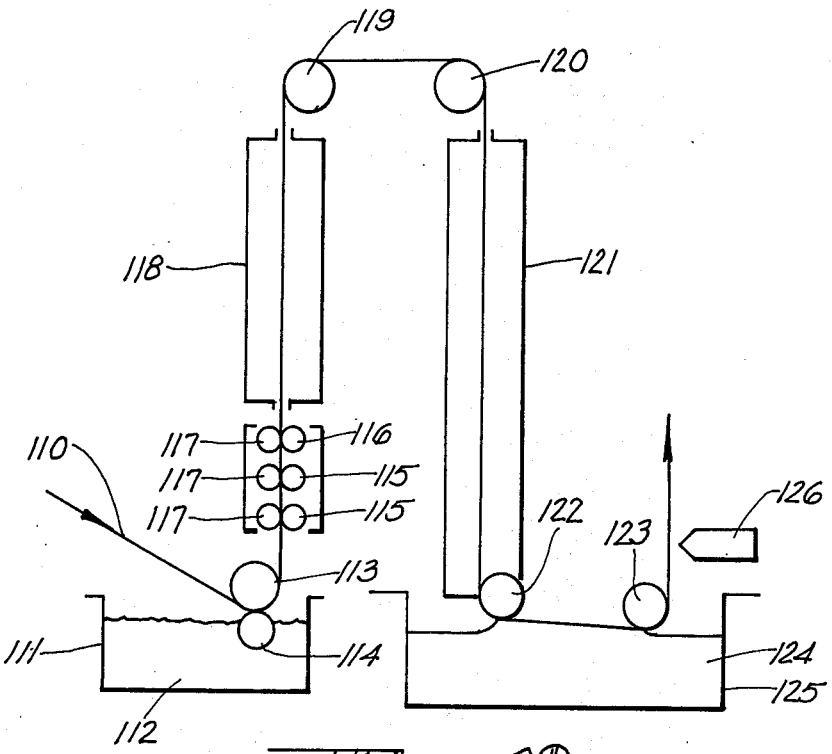
FIG. 19 is a diagrammatic representation of a coating line employing chemical strip preparation techniques and the one-side coating system of the present invention.

FIG. 19 is a diagrammatic representation of the teachings of the present invention as applied to such chemical base metal strip preparation techniques. In FIG. 19 the base metal strip is indicated at 110. A vat 111 is illustrated containing a flux bath 112. The base metal strip is caused to pass about a backing roll 113 while flux is applied to that surface to be coated by an inking roll 114 partially submerged in the flux bath 112. While it would be within the scope of the invention to apply flux to both sides of the base metal strip 110, it is preferred to apply the flux only to that side to which the coating metal is to be applied since this would reduce fuming, would decrease the possibility of coating wrap-around and would eliminate the necessity of a cleaning step to remove flux residues from the uncoated side. It will be understood by one skilled in the art that the use of an inking roll to apply the flux to one side only of the base metal strip is simply an exemplary method by which this may be accomplished. The flux could be applied to the one side of the strip by a sponge or pad wiping system or any other appropriate and well known means.

From the flux bath, the base metal strip 110 passes through means to assure the proper thickness of the flux coating on the strip, again as is well known in the art. Such means may constitute, for example, rubber faced metering rolls 115 or the like followed by a leveling brush 116 or the like. Since one side only of the base metal strip is flux coated, the roll and brush assemblies 115 and 116 may be provided with backing rolls 117 or other appropriate means to adequately support the strip.

Upon achievement of the proper one-side flux coating, the base metal strip 110 is then caused to pass through a heating chamber 118 wherein the strip is heated to evaporate the water in the flux solution. The heating may be accomplished by means of products of combustion, heated air, electric heating elements or the like. This results in a dried, uniform, smooth, one-side flux coating on the base metal strip.

Although the nature of the flux used will have a bearing on the temperature to which the base metal strip may be heated prior to the metallic coating and the speed of the line, the method and means of the present invention are not limited with respect to the particular flux used. Various types of fluxes are well known in the art. For example, zinc chloride and amonium chloride fluxes are frequently used when coating a base metal strip with zinc or terne. Similarly, floride fluxes are often used when the coating metal is aluminum.

From heating chamber 118, the fluxed strip passes about guide rolls 119 and 120 so as to pass downwardly through a heating chamber 121. In heating chamber 121, the base metal strip temperature is raised to that approaching the maximum temperature of stability of the flux coating on the strip. It is desirable to have the strip temperature approach as nearly as possible the temperature of the molten coating metal bath. The strip temperature is, however, limited by flux breakdown which is time and temperature dependent. The ideal situation is to preheat the strip to as near bath temperature as possible for the shortest possible time.

From heating chamber 121 the strip passes about rolls 122 and 123. These rolls are located above the surface of a molten coating metal bath 124 in coating pot 125. The flight of the strip between rolls 122 and 123 is contacted by a molten coating metal meniscus so as to coat one side only of the base metal strip 110. From roll 123 the base metal strip 110 passes upwardly, with its coated side being subjected to jet finishing by jet knife 126.

The arrangement set forth in FIG. 19 is in its simplest form and it will be noted that no protective atmosphere is provided for the base metal strip. The strip can be finished with any appropriate finishing medium such as air, steam, conbustion gases or the like. Nitrogen is a preferred finishing medium since among other things, it tends to prevent coating ripples. After the metal coating step, the base metal strip 110 will have achieved a temperature such that a visible oxide will form on the uncoated side. The visible oxide may be removed in any appropriate way including the acid cleaning processes (followed by rinsing and drying) as taught with respect to FIGS. 8, 9 and 10.

The one side meniscus coating of the base metal strip 110 of the system of FIG. 19 can be accomplished through the use of any of the previously described roll arrangements. To illustrate this, reference is first made to FIG. 20 wherein like parts have been given like index numerals. A coating pot 125 is shown containing a molten coating metal bath 124. The one-side flux coated strip is again shown at 110 and is caused to pass about a single coating roll 127. The coating roll 127 is equivalent to the single coating roll 35 of FIGS. 7, 11, 12, 13, 14, 16 and 17. The molten metal 124 is agitated or rippled to establish initial contact of the meniscus 128 with the one-side flux coated strip. The strip will support a meniscus of at least ⅛ inch or more above the bath surface, the meniscus supplying the coating metal.

Jet finishing by means of jet knife 126 will be the same as described above. Again, the jet knife can be located in any appropriate position from slightly below the center line of roll 127 upwardly. As indicated above, it is important that the jet knife be so positioned as to not disturb the meniscus 128.

Figure 20:
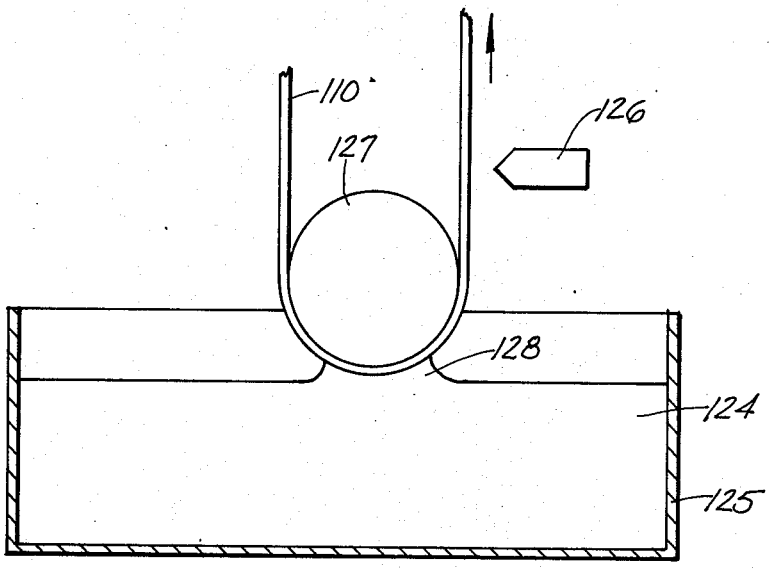
FIG. 20 is a fragmentary semi-diagrammatic cross sectional view illustrating one embodiment of coating apparatus for use with the coating line of FIG. 19.
Figure 21:
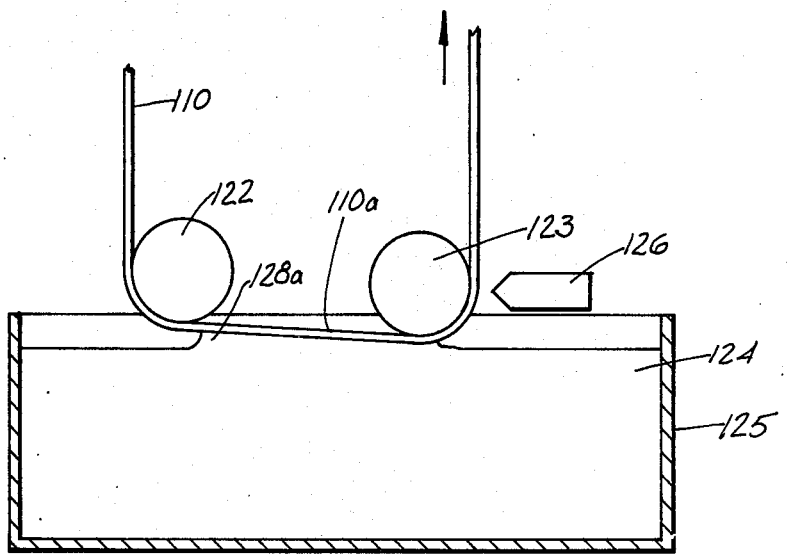
FIG. 21 is a fragmentary semi-diagrammatic cross sectional view of another embodiment of coating apparatus for use with the coating line of FIG. 19.

While excellent results have been achieved utilizing a single support roll 127, the provision of more than one support roll is preferred since an elongated mensicus is produced allowing a longer time for flux reaction and release and enabling higher operating speeds. Reference is made to FIG. 21 wherein the rolls 22 and 23 of FIG. 19 are shown with greater clarity. Again, like parts have been given like index numerals. It will be evident from FIG. 21 that the meniscus **128*a*, as compared to the meniscus 128 of FIG. 20, is considerably elongated. The support rolls 122 and 123 may be so positioned that the flight 110*a* of the base metal strip 110 between the rolls is essentially horizontal and parallel to the upper surface of the molten coating metal bath 124. On the other hand, roll 122 may be slightly higher than roll 123 in the manner and for the purposes described with respect to FIG. 1. Again, jet knife 126 may be positioned from slightly below the center line of roll 123 upwardly, the primary consideration being one of not disturbing meniscus 128*a*. Since meniscus 128*a*** is considerably elongated, more time is afforded for a flux reaction and release. This, in turn, enables faster strip coating speeds.

Figure 22:
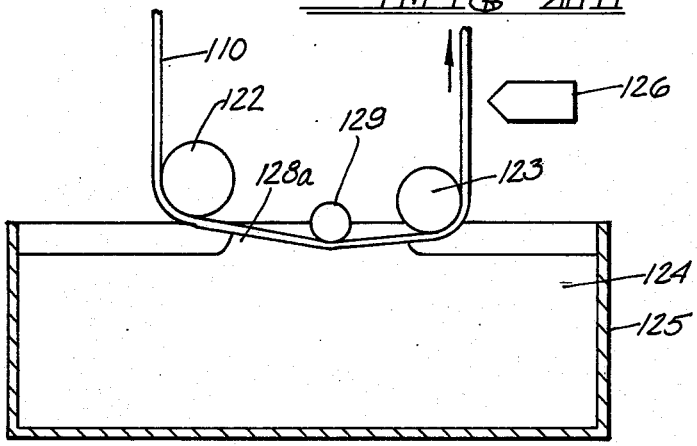
FIG. 22 is a fragmentary semi-diagrammatic cross sectional view of yet another embodiment of coating apparatus for use with the coating line of FIG. 19.

FIG. 22 illustrates a roll arrangement analogous to that of FIGS. 5 and 15. The Figure is otherwise similar to FIG. 21 and again like parts have been given like index numerals. The rolls 122 and 123 may be so located that their axes are equidistant from the upper surface of molten coating metal bath 24. Alternatively, roll 122 may be located slightly above roll 123 for the same reasons described with respect to FIGS. 5 and 15. The embodiment of FIG. 22 differs from that of FIG. 21 only in the provision of a third roll 129 so located as to deflect the flight 110*a* of strip 110 between rolls 122 and 123 slightly downwardly. The provision of roll 129 will allow rolls 122 and 123 to be located slightly higher above the top surface of the molten coating metal bath 124 assuring against splashing or coating metal pick up by these rolls. The additional roll 129 is preferably of a length slightly less than the width of the base metal strip 110 being run.

In FIG. 22, as in FIGS. 19 through 21, the height of the rolls above the molten coating metal bath, as well as the height of the meniscus have been exaggerated for purposes of clarity. In similar fashion, the amount of deflection of the flight 110*a* of the base metal strip 110 caused by roll 129 has also been exaggerated.

In an alternative running mode, the additional roll 129 may be utilized during and to assist in the formation of meniscus 128*a*. Once the meniscus 128 is fully formed, roll 129 may be retracted providing a straight flight 110*a* between rolls 122 and 123 as shown in FIG. 21.

In all of FIGS. 19 through 22 (and in FIG. 23 to be described hereinafter) the rolls 122, 123 and 129 will be supported by any appropriate roll support means (not shown). Furthermore, as indicated above, flux decomposition is both time and temperature dependent. The actual temperature to which the base metal strip 110 is heated prior to metallic one side coating will depend upon equipment design, desired operating speed and the nature of the flux used. There will, nevertheless, be a temperature differential between the strip and the molten coating metal bath at the time of initial contact with the meniscus and it is therefore preferred that the coating rolls in all of the embodiments of FIGS. 19 through 23 be heated. In all of the embodiments involving the use of a one-side flux coated base metal strip, access should be provided to the meniscus to allow removal of spent flux residues. This can be accomplished in any appropriate manner. Continuous mechanical action such as that of a submerged roll, or by induction stirring, (all as are well known in the art) is preferred. Skimming may also be used.

Figure 23:
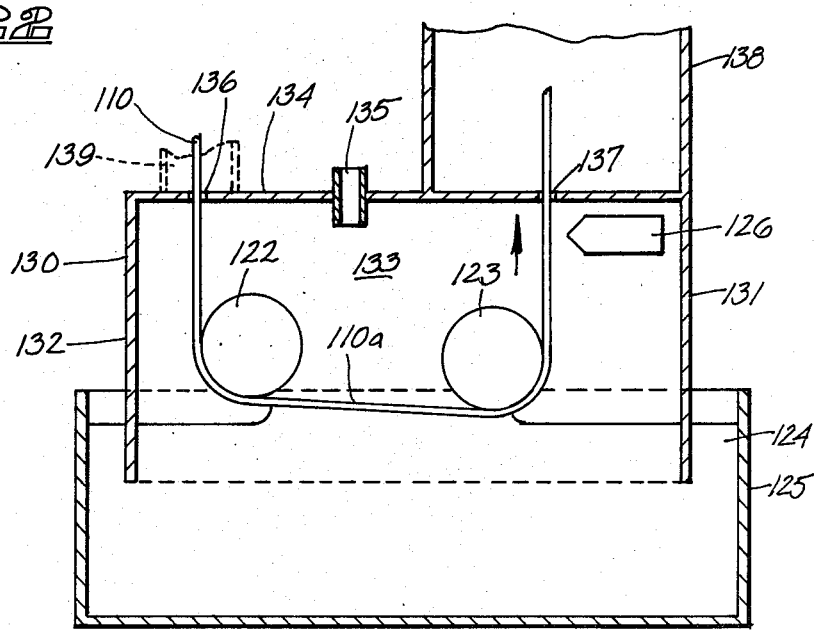
FIG. 23 is a fragmentary semi-diagrammatic cross sectional view illustrating a modification of the structure of FIG. 21.

Reference is now made to FIG. 23 which is similar to FIG. 21 and like parts have been given like index numerals.

In FIG. 23 the coating pot 125 has been provided with a hood 130. The hood has a forward end 131, a rearward end 132, sides (one of which is shown at 133) and a top 134. The sides and ends of hood 130 extend downwardly into the bath 124. The rolls 122 and 126 are located within hood 134 as is jet knife 126. The hood is provided with at least one inlet 135 through which a non-oxidizing atmosphere such as nitrogen, inert gases or the like, may be introduced into the hood.

Hood 130 is provided in its top with a slot 136 through which the one-side flux coated base metal strip enters the hood. The slot 136 may be provided with sealing means or may be so dimensioned that when the non-oxidizing atmosphere within the hood is maintained at a slight positive pressure, the ambient atmosphere will not enter the hood through the slot 136.

The hood 130 has an exit slot 137 through which the one-side metallic coated base metal strip passes upwardly into a cooling hood 138 wherein the one-side metallic coated base metal strip is maintained in a protective, non-oxidizing atmosphere until it cools down to a temperature at which a visible oxide will not form on the uncoated side. The cooling hood 138 may be the equivalent of cooling hood 59 of FIG. 11. On the other hand, additional means may be provided to reduce the temperature of the exiting strip. To this end, cooling hood 138 may be the equivalent of cooling hood 62 of FIG. 12, cooling hood 67 of FIG. 13 or cooling hood 76 of FIG. 14. Any of the temperature reducing means taught with respect to FIGS. 12 through 14 may be employed in the embodiment of FIG. 23. As was true of these previously described embodiments, that portion of the top 134 of hood 130 within the confines of cooling hood 138 and containing exit slot 137 may be eliminated.

The jet finishing knife 126 is, for purposes of an exemplary showing, illustrated as being mounted within hood 130 in the same manner described with respect to FIGS. 11 through 14. The jet knife 126 could be mounted in the manner described with respect to FIG. 16.

It would be within the scope of the present invention to provide a protective atmosphere for the base metal strip ahead of hood 130. For example, a protective atmosphere could be provided within heating chamber 121. The heating chamber 121 could be connected with hood 130 through a snout or conduit, fragmentarily indicated in broken lines at 139. The protective atmosphere would be maintained within conduit 139 as well. In fact, if desired, the base metal strip could be provided with a protective atmosphere from the one-side flux coating step onward. In any of these embodiments, however, means must be provided for the removal of spent flux residues.

From the above it will be evident that the continuous one-side coating method and means of the present invention are applicable to flux coated base metal strips. A meniscus can supply coating metal for a continuous edge-to-edge coating with no detrimental effects from the action of the flux. The meniscus does demonstrate sufficient tenacity to remain intact and produce a coating free from discontinuities, despite the activity of the flux in the meniscus.

In all of the coating methods and means described above, the bath temperature will depend upon the molten coating metal used. The bath must be maintained at a sufficient temperature to assure that the coating metal will be and will remain molten until finished by the jet knife. Unlike conventional hot-dip coating procedures wherein the strip to be coated (both sides) is submerged in the bath, the one-side coating procedures of the present invention cannot depend upon the strip itself to impart a significant amount of heat to the molten coating metal bath. Bath temperature practice should be essentially the same as that for good two-side coating practice and should be held as constant as possible to minimize dross formation. In all of the embodiments described, particularly since they rely upon the formation of a meniscus, the appropriate bath level must be constantly maintained. To this end a pneumatic displacement chamber or mechanical displacement plug may be employed for precise bath level adjustment, as is known in the art. Automatic bath level control means (again as well known in the art) should preferably be used.

The molten coating metal bath may be heated in any conventional manner including the use of electric resistance elements, induction heating, immersion tube heating and the like. It will be understood by one skilled in the art that the volume of the molten coating metal bath may be far less than that required in typical hot dip (both sides) coating procedures. Since, in accordance with the present invention, strip-bath contact is greatly reduced, the rate of dissolution of the strip as compared to the rate of molten coating metal required to be added to the bath will be such that the bath may not become saturated with iron and dross formation will be minimized or eliminated. This, in turn, will result in a defect-free coating. For this reason it is preferred that the molten coating metal pot be lined with an appropriate ceramic material.

In all of the above described embodiments the temperature of the ferrous base metal strip as it exits the conventional pretreatment hood and enters the coating snout will again depend upon the molten coating metal used and is readily determinable by one skilled in the art. The strip temperature should be sufficiently high as to prevent casting of the molten coating metal thereon. By the same token, the strip temperature must not be so high as to bring about excess coating metal-base metal alloying.

In all of the embodiments (except those involving the use of a flux), a non-oxidizing atmosphere must be maintained within the snout. Any appropriate non-oxidizing atmosphere including nitrogen or in inert gas will serve the purpose. The non-oxidizing atmosphere within the snout must be maintained at a pressure sufficient to prevent the entrance of an oxidizing atmosphere into the snout through the snout exit. The same is, of course, true of a cooling hood such as those described with respect to FIGS. 11 through 14 and 23. The dew point within the snout should be maintained at a level comparable to that permissible for ordinary (both sides) coating procedures. This level is dependent on strip temperature and percentage of hydrogen in the atmosphere of the strip preparation operation as is well known in the art.

In all of the embodiments described above, that roll or those rolls located near the molten coating metal bath should preferably be provided with a surface which will not be easily wet by the molten coating metal. This will facilitate removal of any coating metal on the rolls by virtue of accidental pick up or splashing. If desired, that roll or those rolls near the molten coating metal may be crowned or otherwise shaped so that unused portions beyond the edges of the strip being coated will taper slightly away from the bath surfaces. This will further facilitate strip tracking.

The present invention has been taught above in various embodiments. The selection of a particular embodiment or combination of embodiments will depend upon a number of factors including equipment already available, coating metal used, the desired characteristics for the final one-side coated product and the like. This selection is, of course well within the skill of the worker in the art. For example, in those embodiments taught above wherein jet finishing is accomplished with a non-oxidizing gas inside the snout (for example the embodiment of FIG. 7), a number of advantages are obtained. These advantages include a lack of coating ripples even at very low speeds; a lack of bath surface oxide related problems; a reduction of dross defect problems; no oxide curtains on the finished coating; and a virtual elimination of top skimming formation. On the other hand, with this procedure the operator must watch for coating metal fume and powder formation and the possibility of coating metal specks on the uncoated side of the strip.

In an embodiment such as that illustrated in FIGS. 17 and 18 wherein a non-oxidizing jet finishing gas is used outside the chamber but before the strip contacts an air atmosphere, all of the above noted advantages for jet finishing within the snout are obtained. This process also reduces the problem of coating metal dust accumulation in the snout and eliminates coating metal specks on the uncoated side of the strip. On the other hand, the non-oxidizing gas used in jet finishing is not available to create a positive pressure in the snout.

In an embodiment such as that of FIG. 1 wherein air finishing is used in the ambient atmosphere outside of the snout, the finishing operation is exposed for ease of operation and there will be no coating metal fumes, dust or speck problems. The consumption of a non-oxidizing atmosphere is also reduced. On the other hand, most of the advantages obtained when finishing is conducted with a non-oxidizing atmosphere inside the snout are not obtained by this procedure although this disadvantage may be partially reduced by using a non-oxidizing atmosphere (such as nitrogen) after the strip has been exposed to the ambient air atmosphere.

Those embodiments utilizing a single roll configuration (such as FIGS. 7 and 20, for example), are characterized by simplicity of apparatus; a minimizing of poor strip shape problems; and a minimizing of contact length between the strip and the mensicus for the best chance to avoid iron buildup in the bath. With the single roll configuration, care must be taken to avoid zinc pick-up on the single roll and the reduced meniscus area will require close jet finishing control to avoid disruption of the meniscus thereby.

The use of the double roll configuration permits finishing in air (as in FIG. 1) or within the snout as in FIG. 15. The longer contact between the meniscus and the strip will render the meniscus less easily disrupted and will give the flux more time to react and release in the case of FIGS. 21 and 23. By the same token, this longer meniscus contact will provide a greater opportunity for iron dissolution from the strip. The double roll configuration is more complex from an apparatus standpoint and greater care must be taken with regard to strip shape.

The triple roll configuration of FIGS. 5, 15 and 22 will have all of the advantages of the double roll configuration plus the ability to increase the distance of the large rolls from the bath surface. This configuration will also have all of the disadvantages of the double roll configuration together with the fact that it is even more complex with respect to apparatus and care must be taken to assure that the intermediate roll does not mark or otherwise damage the strip, particularly in the coating of very wide strip.

EXAMPLE I

A 28 gauge ferrous base metal strip was one-side coated with zinc utilizing the coating apparatus and process set forth with respect to FIG. 1. At a strip speed of 40 feet per minute the strip was caused to enter the snout at a strip temperature of approximately 870° to 880° F. The bath temperature was maintained at 860° F.

A non-oxidizing, protective nitrogen atmosphere was introduced into the snout at the rate of 700 cubic feet per hour. At turn down roll 12 a dew point of −9° F. was recorded, together with 120 ppm oxygen.

Jet nozzle 19 had a nozzle gap of 0.030 inches and was provided with air at a plenum pressure of 0.9 psi. The nozzle was maintained at a height of approximately 6 inches above the level of the bath and was directed upwardly at an angle of about 2 or 3 degrees. Roll 14 was a 12 inch diameter roll. The nozzle was maintained at a distance of about 3/16 inch from the coated side of the strip.

As a result of the above outlined procedure, the ferrous base metal strip was provided on one side with a zinc coating having a coating weight of 0.19 ounces per square foot. When subjected to conventional quality tests including tests for adherence, the zinc coating proved to be excellent. The uncoated side of the strip had a light oxide film thereon and showed no zinc wrap-around.

EXAMPLE II

A 28 gauge ferrous base metal strip was one-side coated with aluminum utilizing the coating apparatus and process set forth with respect to FIG. 1. At a strip speed of 50 feet per minute the strip was caused to enter the snout at a strip temperature of approximately 1300° F. The molten coating metal bath temperature was maintained at 1270° F.

A nonoxidizing, protective nitrogen atmosphere was introduced into the snout at the rate of 300 cubic feet per hour. At turn down roll 12 a dew point of −10° F. was recorded, together with less than 100 ppm. oxygen.

Jet nozzle 19 had a nozzle gap of 0.030 inches and was provided with air at a plenum pressure of 0.75 psi. The nozzle was maintained at a height of approximately 4 inches above the level of the bath and was directed upwardly at an angle of about 10°. Roll 14 had a diameter of 12 inches. The nozzle was maintained at a distance of from about ⅛ to about 3/16 inch from the coated side of the strip.

As a result of the above procedure, the ferrous base metal strip was provided on one-side with an aluminum coating having a coating weight of 0.19 ounces per square foot. When subjected to conventional quality tests including tests for adherence, the aluminum coating proved to be excellent.

Modifications may be made in the invention without departing from the spirit of it. For example, in those embodiments wherein an oxide film is formed on the uncoated side of the ferrous base base metal strip, the oxide film not necessarily be removed by acid cleaning. The oxide film is adherent and readily accepts a pretreatment for painting such as phosphatizing. Under these circumstances the uncoated side with a pretreated oxide film will demonstrate excellent paintability properties.

EXAMPLE III

A 28 gauge ferrous base metal strip was first coated with a $ZnCl_2$—$NH_4Cl$ flux and thereafter one-side coated with zinc utilizing the coating apparatus and process set forth with respect to FIG. 20. At a strip speed of 10 feet per minute the strip was caused to contact the meniscus at a temperature of from about 300° F. to about 500° F. The bath temperature was maintained at about 850° F.

The roll 127 had a diameter of 12 inches. The base metal strip was provided on one side with a zinc coating having a coating weight of 0.46 ounces per square foot. The uncoated side of the strip had a visible oxide film formed thereon.

EXAMPLE IV

A 28 gauge ferrous base metal strip was first one-side coated with a $ZnCl_2$—$NH_4Cl$ flux and thereafter one-side coated with zinc utilizing the coating apparatus and process set forth with respect to FIG. 19. At a strip speed of 30 feet per minute the strip was caused to contact the meniscus at a temperature of from about 300° F. to about 500° F. The bath temperature was maintained at about 850° F.

The rolls 122 and 123 each had a diameter of 12 inches and were spaced about 14 inches apart, center-to-center. The base metal strip was provided on one side with a sound, adherent zinc coating having a coating weight of about 0.4 ounces per square foot. The uncoated side of the strip had a visible oxide film formed thereon.

In the embodiments described above the finishing of the coated side is described in terms of the use of a jet knife. Other well known finishing techniques may, of course, be used including asbestos wipe means and the like.

The embodiments of the invention in which an exclusive property or privilege is claimed are defined as follows:

1. In a process of producing a ferrous base metal strip having coating metal on one side only, the other side of said strip remaining free of said coating metal, said ferrous base metal strip having been subjected to chemical preparation including the application of a flux to at least said one side thereof and having been treated to bring the ferrous base metal strip to a coating temperature sufficiently high to prevent casting of said coating metal thereon and low enough to prevent excess coating metal-base metal alloying, the improvement comprising the steps of providing a coating pot containing a molten bath of said coating metal, conducting said strip to a position above the upper surface of said bath with said one side of said strip facing said bath such that the surface tension and wetting characteristics of said molten coating metal will permit the formation of a meniscus at said upper surface of said bath contacting said one side of said strip, forming said meniscus, maintaining said meniscus and continuously contact coating said one side only of said strip therewith and finishing said coating said of said strip.

2. The process claimed in claim 1 wherein said molten coating is metal is chosen from the class consisting of zinc, zinc alloys, aluminum, aluminum alloys and lead alloys.

3. The process claimed in claim 1 including the steps of utilizing a single roll to conduct said strip to said meniscus forming position with respect to said bath surface and utilizing said single roll to conduct said coated strip away from said bath surface after said one-side coating.

4. The process claimed in claim 1 including the steps of providing first and second rolls in parallel spaced relationship, causing said strip to pass thereabout, forming said meniscus against said strip at the flight thereof between said rolls.

5. The process claimed in claim 4 including the step of depressing said strip flight toward said molten coating metal bath.

6. The process claimed in claim 1 including the steps of coating said strip in the ambient atmosphere, jet finishing said coated side of said strip with air in said ambient atmosphere and subjecting said one-side coated strip to acid cleaning.

7. The process claimed in claim 6 including the steps of providing a dilute acid bath for said acid cleaning step, conducting said one-side coated and finished strip through said bath, providing an electrode of sacrificial metal adjacent said uncoated strip side within said acid bath and electrically connecting said electrode and said strip whereby to remove said oxide film from said uncoated strip side.

8. The process claimed in claim 6 including the steps of providing a dilute acid bath for said acid cleaning step, conducting said one-side coated and finished strip through said bath, providing an electrode adjacent said uncoated strip side within said bath and providing means to connect said strip and said electrode across a source of current.

9. The process claimed in claim 8 wherein said source of current is an A.C. source.

10. The process claimed in claim 8 wherein said source of current is a D.C. source.

11. The process claimed in claim 8 including the step of providing an electrode in said molten coating metal bath, connecting said last mentioned electrode to said source of current whereby to connect said strip to said source of current.

12. The process claimed in claim 8 wherein said molten coating pot is metallic, connecting said pot to said source of current whereby to connect said strip to said source of current.

13. The process claimed in claim 6 including the step of causing said uncoated side of said one-side coated and finished strip to pass in contact with a sponge containing a dilute acid solution, providing means to connect said strip and said sponge across a source of electric current and continuously supplying said dilute acid solution to said sponge whereby to remove said oxide film from said uncoated strip side.

14. The process claimed in claim 1 including the step of maintaining said ferrous base metal strip in a protective atmosphere throughout said coating and finishing steps and until said strip has cooled to a temperature such that an oxide film will not form on said uncoated side thereof.

15. The process claimed in claim 14 including the step of causing said one-side coated and finished strip to pass about chilled rolls to accelerate the cooling of said strip to a temperature at which an oxide film will not form on said uncoated side.

16. The process claimed in claim 14 including the step of blowing a cooled protective, non-oxidizing gas against said one-side coated and finished strip to accelerate the cooling of said strip to a temperature at which an oxide film will not form on said uncoated side.

17. The process claimed in claim 1 including the steps of maintaining said ferrous base metal strip in a protective atmosphere throughout said coating and finishing steps and subjecting said one-side coated strip to a water quench prior to introducing it into the ambient atmosphere.

* * * * *